US009255562B2

(12) United States Patent
Wanner

(10) Patent No.: US 9,255,562 B2
(45) Date of Patent: Feb. 9, 2016

(54) STARTER HAVING A SWITCHABLE NUMBER OF POLE PAIRS

(75) Inventor: Hartmut Wanner, Herrenberg-Oberjesingen (DE)

(73) Assignee: Robert Bosch GmbH, Stuttgart (DE)

( * ) Notice: Subject to any disclaimer, the term of this patent is extended or adjusted under 35 U.S.C. 154(b) by 638 days.

(21) Appl. No.: 13/318,306

(22) PCT Filed: Apr. 29, 2010

(86) PCT No.: PCT/EP2010/055799

§ 371 (c)(1),
(2), (4) Date: Jan. 17, 2012

(87) PCT Pub. No.: WO2010/125139

PCT Pub. Date: Nov. 4, 2010

(65) Prior Publication Data

US 2012/0104769 A1 May 3, 2012

(30) Foreign Application Priority Data

Apr. 29, 2009 (DE) ..... 10 2009 002 721

(51) Int. Cl.
*F02N 11/08* (2006.01)

(52) U.S. Cl.
CPC ..... *F02N 11/0859* (2013.01); *F02N 11/0851* (2013.01); *F02N 11/087* (2013.01); *F02N 2011/0874* (2013.01); *F02N 2300/102* (2013.01)

(58) Field of Classification Search
CPC ..... F02N 11/04; F02N 11/087; H02K 23/26; H02K 23/28; H02K 23/30; H02K 23/32; H02K 23/34; H02K 23/36
USPC ..... 290/36 R, 38 R; 74/6–9; 123/179; 335/126, 131; 310/184
See application file for complete search history.

(56) References Cited

U.S. PATENT DOCUMENTS

| | | | |
|---|---|---|---|
| 3,177,368 | A | 4/1965 | Seilly |
| 7,804,180 | B2 | 9/2010 | Labbe et al. |
| 8,258,639 | B2 * | 9/2012 | Labbe et al. ..... 290/38 A |

(Continued)

FOREIGN PATENT DOCUMENTS

| | | |
|---|---|---|
| AT | 181141 | 2/1955 |
| DE | 1250194 | 4/1968 |

(Continued)

OTHER PUBLICATIONS

Robert Bosch Corporation "Kraftfahrttechnisches Taschenbuch" 25th edition, p. 986.

(Continued)

*Primary Examiner* — Tulsidas C Patel
*Assistant Examiner* — Sean Gugger
(74) *Attorney, Agent, or Firm* — Michael Best & Friedrich LLP

(57) ABSTRACT

The invention relates to a starter (10) for an internal combustion engine, comprising a starter motor (12), which can be connected to a direct voltage network (30, 31) by means of a switching device (27). In order to improve the process of meshing a starter pinion (22) into a ring gear (26) of an internal combustion engine, it is proposed that the excitation winding (37) of the starter motor (12) be divided into several partial windings (a-f), which can optionally be connected to the direct voltage network (30, 31) by the switching device (27) in a staggered manner.

19 Claims, 6 Drawing Sheets

(56) References Cited

U.S. PATENT DOCUMENTS

| | | | | |
|---|---|---|---|---|
| 2004/0012204 | A1* | 1/2004 | Walter et al. | 290/36 R |
| 2006/0038405 | A1* | 2/2006 | Xu et al. | 290/31 |
| 2006/0261690 | A1* | 11/2006 | Petersen | 310/68 B |
| 2008/0211235 | A1* | 9/2008 | Labbe et al. | 290/38 R |
| 2009/0284022 | A1* | 11/2009 | Usselman et al. | 290/38 R |
| 2011/0057597 | A1* | 3/2011 | Bosch et al. | 318/497 |

FOREIGN PATENT DOCUMENTS

| | | |
|---|---|---|
| DE | 2843984 | 4/1980 |
| DE | 19721386 | 6/1998 |
| DE | 10314769 | 10/2004 |
| EP | 0848159 | 6/1998 |
| JP | 2204676 | 8/1990 |
| JP | 4094459 | 3/1992 |

OTHER PUBLICATIONS

PCT/EP2010/055799 International Search Report.

* cited by examiner

STARTER HAVING A SWITCHABLE NUMBER OF POLE PAIRS

BACKGROUND OF THE INVENTION

The invention relates to a starter for an internal combustion engine. By way of example, one such starter is described in the "Kraftfahrttechnisches Taschenbuch", a book on motor transport technology issued by the Robert Bosch Corporation, 25$^{th}$ edition, p. 986, in the form of a pre-engaged Bendix starter, which is actuated via a so-called pull-in relay. This relay carries out the pulling-in functions, that is to say meshing the pinion of the starter motor into the ring gear of an internal combustion engine and switching the main current of the starter motor. When meshing the pinion into the ring gear, a tooth of said pinion can strike against a tooth of said ring gear, which is why the engagement process is assisted by a meshing spring. This starter design, which is known from prior art, admittedly requires only a single relay and can therefore be produced at relatively low cost, but on the other hand it results in very difficult working conditions for the process of meshing said starter pinion into said ring gear and for the switching process for the high motor current. Working conditions are particularly difficult in this embodiment of the switching device for the main current of the starter, the maximum possible torque of which is already produced during start-up from rest. If the pinion of the starter motor is not thereby completely engaged into the ring gear of the internal combustion engine, at the least inadmissibly large loads on the toothing of the ring gear can occur over the service life of the starter. This gives rise to the danger of one or a plurality of teeth breaking off.

In order to improve the process of meshing a starter pinion into a ring gear of an internal combustion engine, particularly in the case of high-power starters, it is furthermore known from the aforementioned reference for the motor current to be switched on in two stages in so-called pre-engaged starters. In a first stage, the pinion of the starter is moved against the ring gear of the engine and the armature of the starter motor is at the same time fed with a reduced current; thus enabling said armature and, with it, said starter pinion to rotate when meshing into said ring gear. In so doing, the meshing process is made easier. The meshing mechanism is in this case provided with a ratchet, which only at the end of the process of meshing the starter pinion closes a further switching contact of the relay and via said contact closes the main current circuit of the motor. As a result, the meshing process and the switching of the main current of the motor can take place in two separate operating stages; however, the design of the pull-in relay is thereby more complicated and more susceptible to defects from the mechanical and electrical points of view. The main current of the starter motor is, however, likewise powered up in one switching operation; thus enabling the maximum torque of the starter to already be present at the pinon/gear ring interface while the internal combustion engine with its large mass is still at rest.

SUMMARY OF THE INVENTION

The starter according to the invention has the advantage that as a result of meshing the pinion by connecting the partial windings of the excitation winding in a delayed manner, the characteristics of the starter motor are manipulated in such a way that less stress is placed on the gearing between said starter motor and the internal combustion engine during the process of meshing the two. Furthermore, the behavior of the rotational speed is positively influenced particularly by the shift in the idle rotational speed during start-up of the starter. By the connection of additional pole pairs to the associated partial windings, the maximum available torque of the starter is then first achieved at a point in time when the starter pinion is fully meshed into the gear ring of the internal combustion engine and the internal combustion engine has already broken away. In so doing, inadmissibly large loads on the gearing are avoided and the service life of said gearing is considerably increased.

It is very useful in achieving an advantageous change in the engine characteristics if the partial windings of the excitation winding can be selectively connected in series and/or shunt with the armature of the motor. Whereas especially the torque of the engine is reduced during start-up by the reduction of the partial windings, which are operated in a series connection, it is possible by connecting individual partial windings in shunt with the armature to straighten the characteristic curve of the rotational speed and to make the rotational speed behavior of the starter less dependent on the load current. In particular, idle rotational speed can thereby be reduced.

A particularly advantageous embodiment of the starter according to the invention is obtained if the partial windings of the excitation winding are disposed on separate poles of the stator, especially if said stator is designed having six poles and six partial windings on three pole pairs, wherein the partial windings in each case are placed in pairs on opposing poles on the stator periphery. In doing so, a symmetrical arrangement of the exciter partial windings results when said partial windings are powered up and connected up in a delayed manner. The start-up of the motor is thereby improved.

An effective embodiment of the switching device of the starter is obtained if individual or all switching means of the switching device are embodied as relays. However, it is also possible to use suitable semiconductor components, preferably transistors or GTO (Gate Turn Off) thyristors, for switching relatively high currents for all of the switching means or for individual switching means.

One particularly simple and cost-effective circuit design is obtained by current being passed through the starter motor in a single stage, in which case a pull-in winding together with a holding winding of the meshing relay switches a make contact, via which current is passed to initially one or a plurality of excitation partial windings of the starter motor and said starter motor is supplied with current via the entire excitation winding only at the end of the meshing movement of the meshing relay. As is known, an arrangement such as this requires a meshing spring, which in conjunction with a steep-pitched thread assists the meshing process, in particular when the pinion and the ring gear are in a so-called tooth on tooth position.

The holding winding and the pull-in winding of the meshing relay are preferably seated on the same relay core. In the case of current being passed through the starter in a single stage, said holding and pull-in windings are switched in the same sense, whereby the required total flux is achieved with a smaller number of turns and/or a lower excitation current. In the case of the fluxes of the common relay core being opposite, as they are used when current is passed through the motor in two stages, the winding with the lesser flux can be used to damp the switching process. The numbers of turns and the excitation currents for the holding winding and the pull-in winding are in this case expediently chosen such that said holding winding produces the switching process of the meshing relay with a large number of turns and an adequate excitation current; while the pull-in winding is equipped with considerably fewer turns but carries a considerably higher excitation current, which is sufficient to easily rotate the armature during the engagement, repectively meshing.

BRIEF DESCRIPTION OF THE DRAWINGS

Further details and advantageous refinements of the invention will become evident from and the description of the exemplary embodiments, which will be explained in more detail in the following description and are illustrated in the drawings, in which.

DETAILED DESCRIPTION

Figure 1:
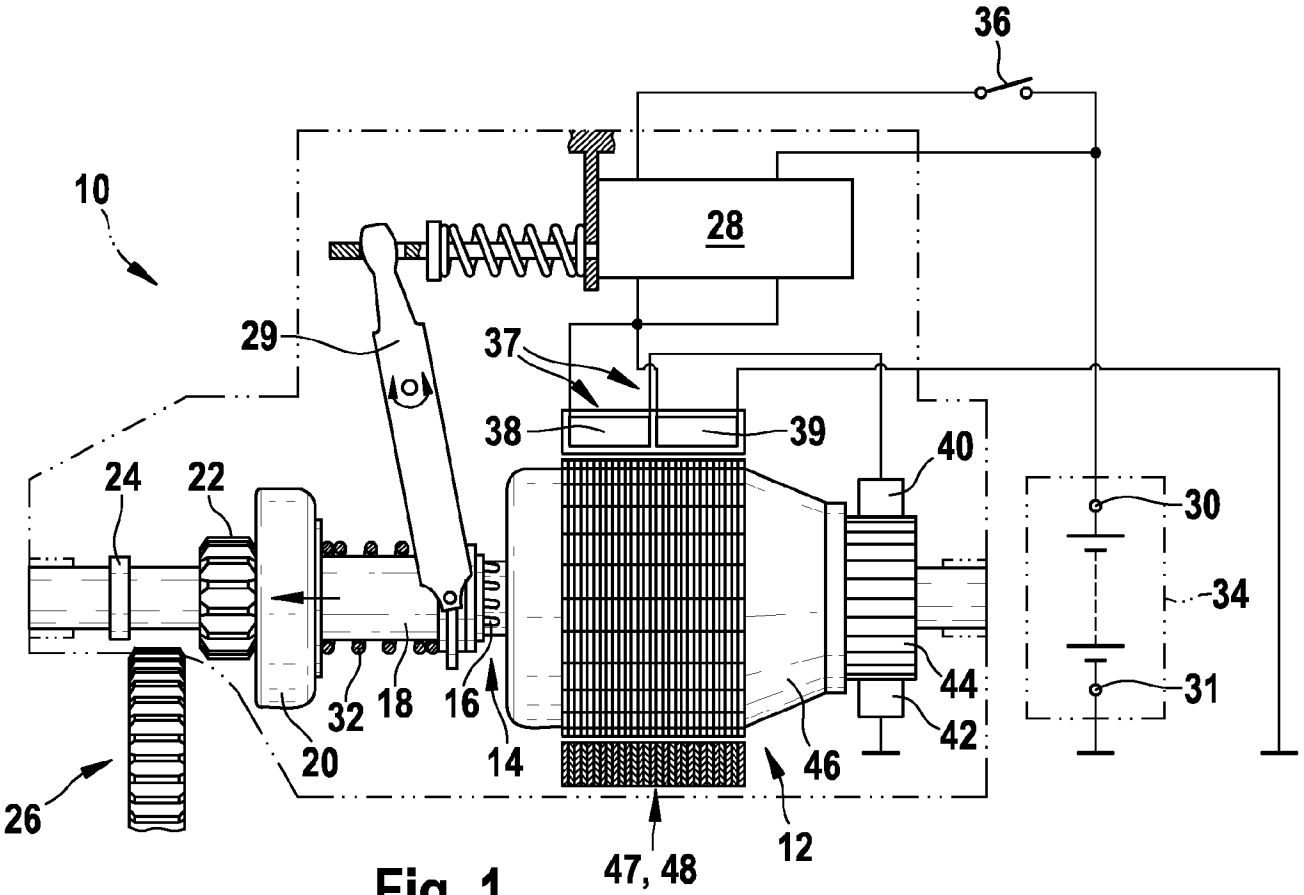
FIG. 1 shows an outline illustration of a pre-engaged Bendix starter comprising a series winding and a shunt winding in the stator.

FIG. 1 schematically illustrates the mechanical design of the starter 10 according to the invention, in the form of a pre-engaged Bendix starter for an internal combustion engine. The starter 10 has a starter motor 12, the output drive shaft 14 of which has a steep-pitched thread, which interacts with a corresponding female thread in a driver shaft 18. Alternatively the output drive shaft 14 is driven via a planetary gear assembly, which is connected in between but is not illustrated. The driver shaft 18 is fixedly connected to the outer ring of a freewheeling ring 20, the inner ring of which is fitted with a pinion 22. The pinion 22 and the freewheeling mechanism 20 are mounted on the output drive shaft 14 such that they can move axially as far as a stop 24. Said pinion 22 in this case meshes into a ring gear 26 of an internal combustion engine, which is not illustrated. The axial movement takes place with the aid of a switching device in the form of a relay arrangement 28, which is illustrated in detail in the following figures and acts on the freewheeling mechanism 20 via a deflection lever 29 and a meshing spring 32. A battery is used as a voltage source 34 for the arrangement. The negative pole 31 of said battery is connected to ground, and the positive pole 30 thereof is connected on the one hand directly and on the other hand via an ignition/starter switch 36 to the relay arrangement 28. An excitation winding 37 having a series winding 38 and a shunt winding 39 is fed via said relay arrangement and is connected directly to ground or via brushes 40 and 42 and via the commutator 44 to ground. The armature of the starter motor 12 is denoted with the reference numeral 46 and the stator thereof with the reference numeral 48.

Figure 2:
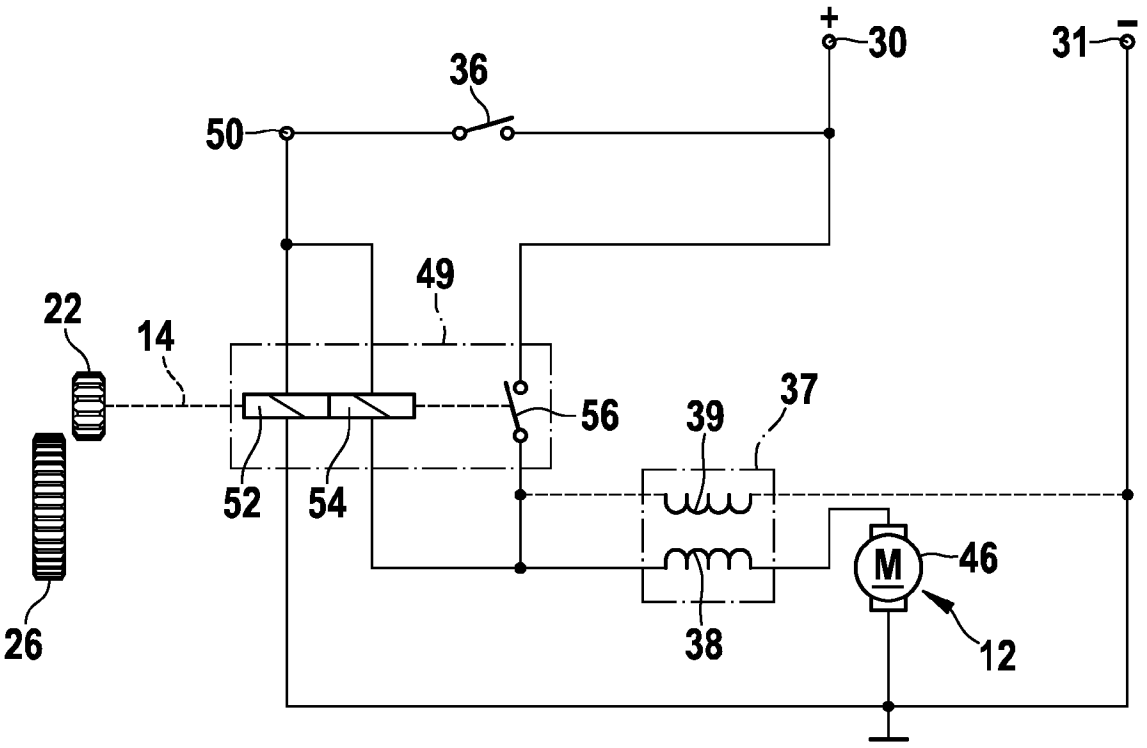
FIG. 2 shows a circuit diagram of a conventional embodiment of a starter through which current is passed in a single stage, said starter comprising a series winding and if applicable an additional shunt winding.

FIG. 2 shows a circuit diagram of a conventional embodiment of a starter through which current is passed in a single stage. In this case, the positive pole 30 of the voltage source is connected to a meshing relay 49 on the one hand via the ignition/starter switch 36 and a connection 50 and on the other hand directly. This meshing relay 49 contains a holding winding 52 and a pull-in winding 54, which are wound in the same sense, are wound on the same core and are both connected at one winding end to the connection 50. The other winding end of the holding winding 52 is connected to the negative pole 31 and to ground, and the corresponding other winding end of the pull-in winding 54 is connected to the negative pole 31 and to ground via the series winding 38 and the armature 46 of the starter motor. In the event a compositely-excited excitation winding is used for the starter motor 12, a shunt winding 39 can be connected in parallel to said series winding 38 and to the armature 46 of the starter motor in a fundamentally known manner.

The holding winding and the pull-in winding of the meshing relay 49 jointly operate a make contact 56 in the meshing relay 49, via which the starter motor 12 is directly connected to the positive pole 30 as soon as the relay armature has pulled in and the pinion 22 has meshed into the ring gear 26.

The holding winding 52 and the pull-in winding 54 in this known arrangement take on the task of meshing the pinion 22 into the ring gear 26 on the internal combustion engine and at the same time the function of switching the main current for the starter motor 12. If, during this process, a tooth of said pinion 22 meets a gap in said ring gear 26, only a small amount of force is then required for engagement. If, during engagement, a tooth of said pinion 22 strikes a tooth of said ring gear 26, the meshing spring 32 shown in FIG. 1 is tensioned during engagement and with the aid thereof the meshing process is carried out.

Figure 3:
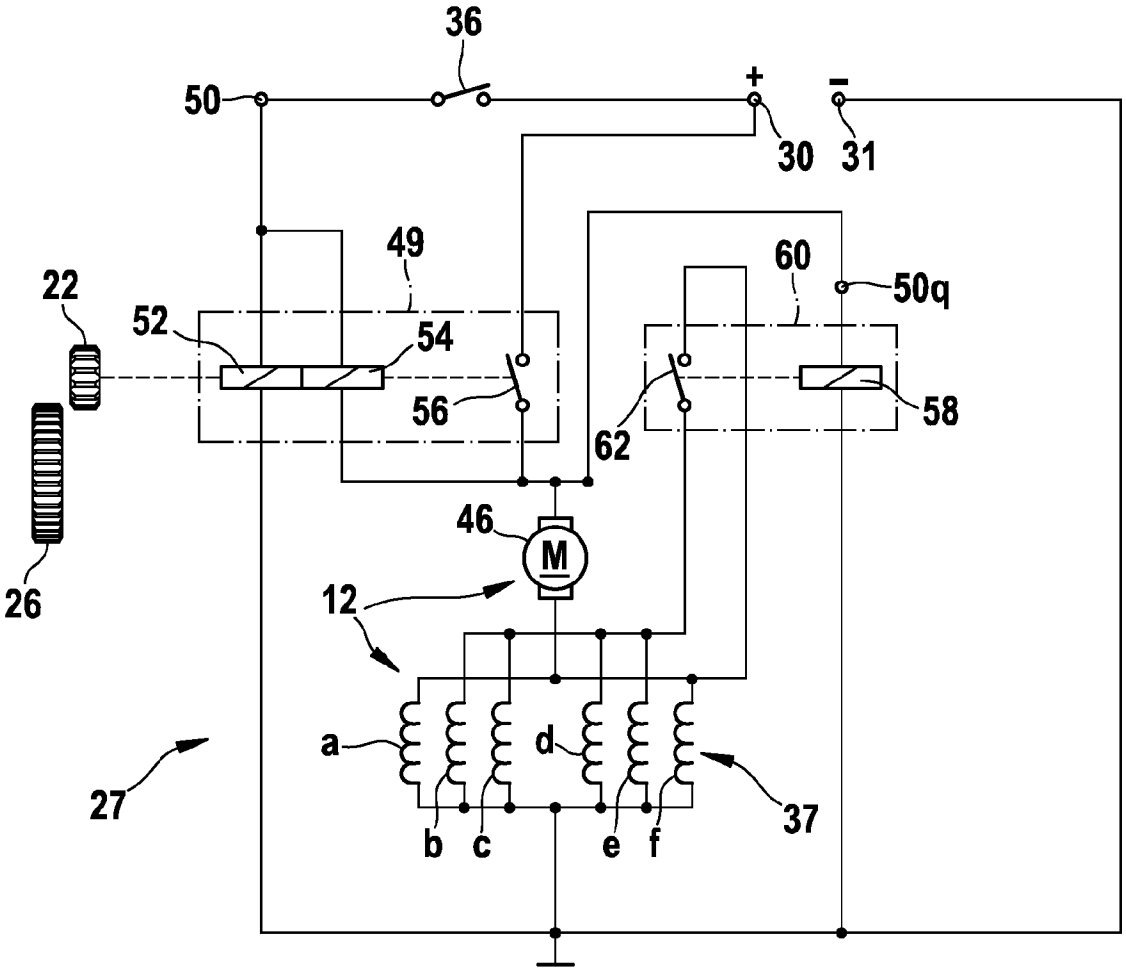
FIG. 3 shows a circuit diagram of an embodiment according to the invention of a starter through which current is passed in a single stage, said starter comprising a series excitation winding.

FIG. 3 shows the circuit diagram of an embodiment according to the invention of a starter through which current is passed in a single stage and with which the danger of damaging the gearing between starter and internal combustion engine, which was described at the beginning of the application, is removed. The design of the circuit arrangement comprising a meshing relay 49 and the connection thereof to the direct voltage network 30, 31 basically corresponds to that in FIG. 2; however, in this arrangement the relay contact 56 does not carry the full motor current at the switch-on moment, but current is only initially passed through the partial windings a and f of the six partial windings a, b, c, d, e and f of the excitation winding 37. The stator of the starter motor 12 is of six-pole design; however, during start-up only the pole pair having two diametrically opposed poles on the stator is supplied with current, while the remaining series partial windings b, c, d and e are switched on later. The starter is actuated via the ignition/starter switch 36 and the terminal 50 and as a result, the positive pole 30 of the direct voltage source is connected to the windings of the holding winding 52 and the pull-in winding, which are wound in the same sense; thus enabling the meshing relay 49 to pull in. In this case, a current flows to the armature 46 of the starter motor 12 via the low-resistance pull-in winding 54 and from there to ground and to the negative pole 31 of the direct voltage source via the partial windings a and f of the excitation winding 37. The pinion 22 is displaced in the direction of the ring gear 26 by the initial current across the starter motor 12. In the process, the meshing spring 32 illustrated in FIG. 1 is compressed for assisting the meshing process. The make contact 56 of the meshing relay 49 is actuated, after said meshing relay has pulled in virtually entirely, so that said contact directly connects the starter motor 12 to the positive pole 30 of the direct voltage source.

Current is initially supplied only to the two partial windings a and f of the six partial windings a-f and the associated poles of the field winding. At the same time said partial windings a and f are being supplied with current, current is, however, also passing through the winding 58 of the switching relay 60 via the make contact 56 of the meshing relay 49. Said switching relay 60 now likewise pulls in and closes the make contact 62 thereof with a delay time of approximately 20-80 ms from the start of excitation. In so doing, current passes through the remaining partial windings b, c, d and e again via the armature 46 and the associated poles are excited. The starter motor thereby achieves its full power for starting up the internal combustion engine at a point in time, whereat the pinion 22 completely meshes into the ring gear 26, and the danger of damaging the gearing is avoided.

Figure 4:
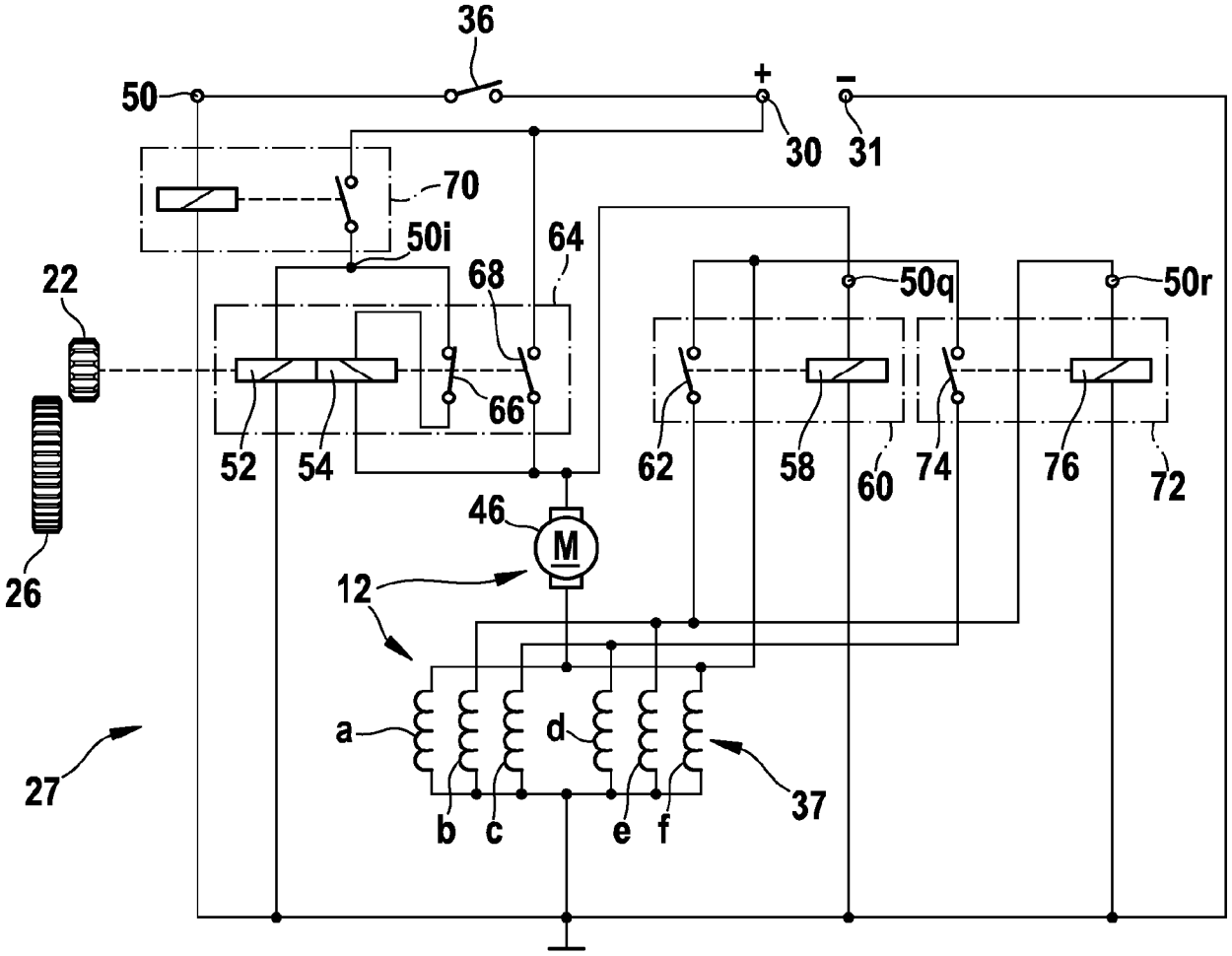
FIG. 4 shows a circuit diagram of an embodiment according to the invention of a starter through which current is passed in two stages, said starter comprising a series excitation winding.

FIG. 4 shows a circuit arrangement for passing current through the starter motor 12 in two stages. Instead of the meshing relay 49 in FIG. 3, there is a meshing relay 64 having a normally-closed contact 66 and a make contact 68. The normally-closed contact 66 with the pull-in winding 54 and the holding winding 52 are in this case connected to the positive pole 30 of the direct voltage source via a pilot control relay 70, the connection point 50 and the ignition/starter switch 36. The second terminal connection of the holding winding 52 is connected to ground and to the negative pole 31 of the direct voltage source, while the second terminal connection of the pull-in winding 54 is connected on the one side via the starter motor 12 and on the other side via the winding 58 of a switching relay 60 to ground and to the negative pole 31 of the direct current source. In this case, the two partial windings a and f are in turn initially supplied with current so that a torque current for the starter motor ensues during the meshing process via said partial windings and said pull-in winding 54 of the engagement relay 64. After closing the make contact 68, the torque current flows directly from the positive pole 30 to the motor 12 via said make contact. With the partial energization of said starter motor 12, current also passes to the winding 58 of the switching relay 60 via the connection point 50*q*, whereby the relay pulls in and closes the make contact 62 with a delay time of approximately 20-80 ms from the start of excitation, and consequently current passes into the next two partial windings b and e of the excitation winding and thereby increases the power output of said starter motor 12.

By closing the make contact 62 of the switching relay 60, the winding 76 of a further switching relay 72 is also now supplied with current via the connection point 50*r*; thus enabling said switching relay 72 to pull in and close the make contact 74 thereof with a further delay time of approximately 20-80 ms from the start of excitation of the winding 76. Current is passed through the last two partial windings c and d of the excitation winding 37 via said make contact 74, and the starter motor 12 thereby achieves full power capacity. In contrast to the circuit arrangement in FIG. 3, the increase in power is carried out in this case in three instead of two switching stages and the mechanical loading of the pinion/ring gear connection to the internal combustion engine is more evenly executed.

In this embodiment, the two windings 52 and 54 of the meshing relay 64 have an opposite direction of winding, wherein the holding winding 52 has a considerably higher number of turns than the pull-in winding 54 and is excited with a sufficiently large current in order to execute alone the process of meshing the pinion 22 into the ring gear despite the flux of said pull-in winding 54 directed thereagainst. In the process, said pull-in winding 54 damps in an advantageous manner the dynamics of the meshing movement and delivers at the same time a sufficiently high excitation current to the series partial windings a-f of the starter motor 12 in order to slightly rotate said starter motor and ease or facilitate the meshing process. A meshing spring for assisting the meshing process can additionally be used in this arrangement.

The use of a pilot control relay 70 for the operation of the circuit arrangement pursuant to FIG. 4 is not absolutely essential, and current can also be passed through the meshing relay 64 directly via the ignition/starter switch, analogously to the circuit arrangement shown in FIG. 3. On the other hand, in the first current-flow phase, the motor current via the pull-in relay 54 is in the order of magnitude of up to 200 A, which means that it is expedient to use a pilot control relay to bypass the ignition/starter switch 36 in the first stage of the current flow, at least for high-power starter motors.

Figure 5:
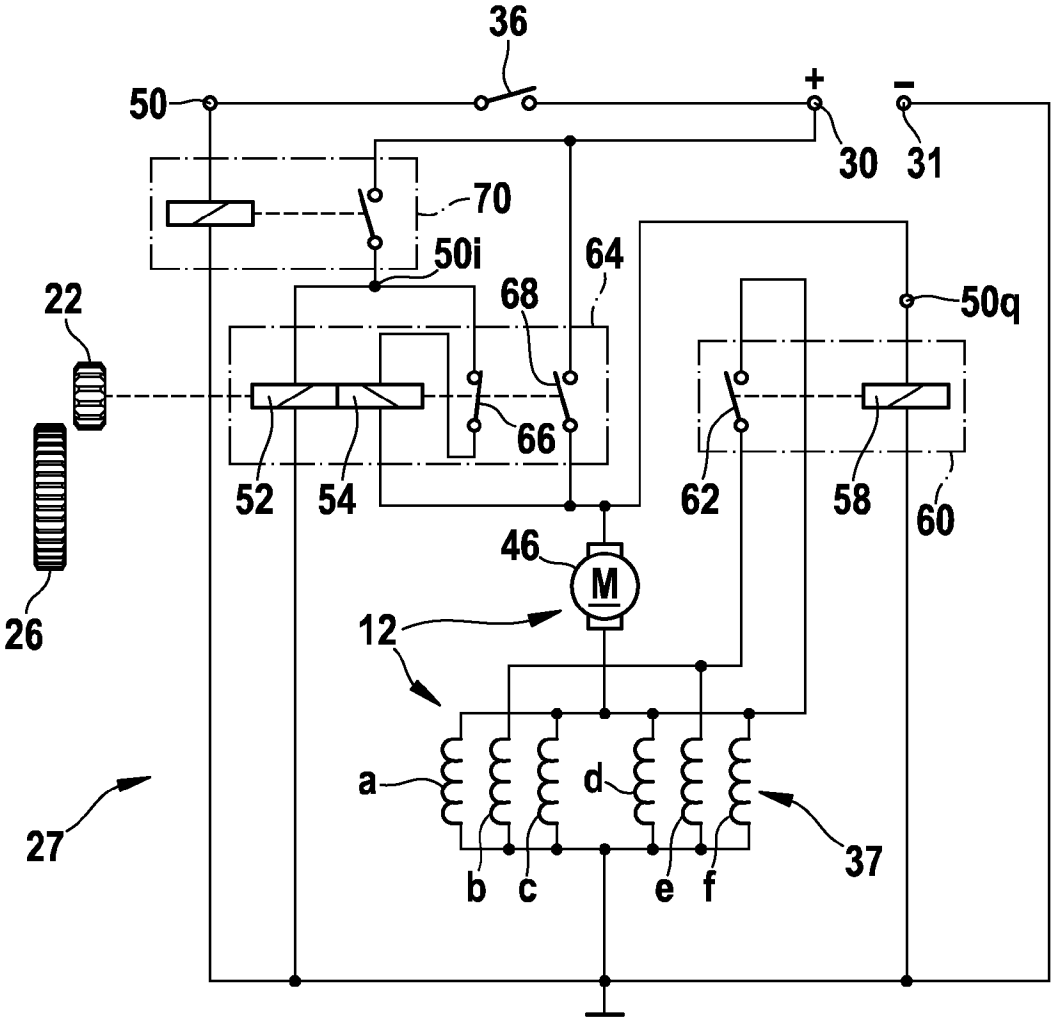
FIG. 5 shows a second circuit diagram of an embodiment according to the invention of a starter through which current is passed in two stages and FIG. 6 shows a third circuit diagram of an embodiment according to the invention of a starter through which current is passed in two stages, wherein the excitation winding of the starter motor is designed partially as a series winding and partially as a shunt winding.

FIG. 5 shows a variant of the circuit arrangement pursuant to FIG. 4, which differs from the previously described embodiment in that the excitation current for the winding 37 is carried via four partial windings a, c, d and f from the start of the series current feed. The activation of two additional partial windings b and e takes place in turn via the connection point 50*q* and the switching relay 60 with a delay time of approximately 20-80 ms from start of excitation. This variant of the circuit arrangement relates then again to current being passed through the partial windings of the excitation winding 37 in two stages, analogously to the circuit arrangement of FIG. 4, wherein, however, current is passed through four partial windings already in the first switching operation. This is especially facilitated by the use of the pilot control relay 70, which unloads the ignition/starter switch 36 and allows the higher initial current feed to the starter motor provided that in doing so, the mechanical loading of the pinion/ring gear connection is not too high during the meshing process.

Figure 6:
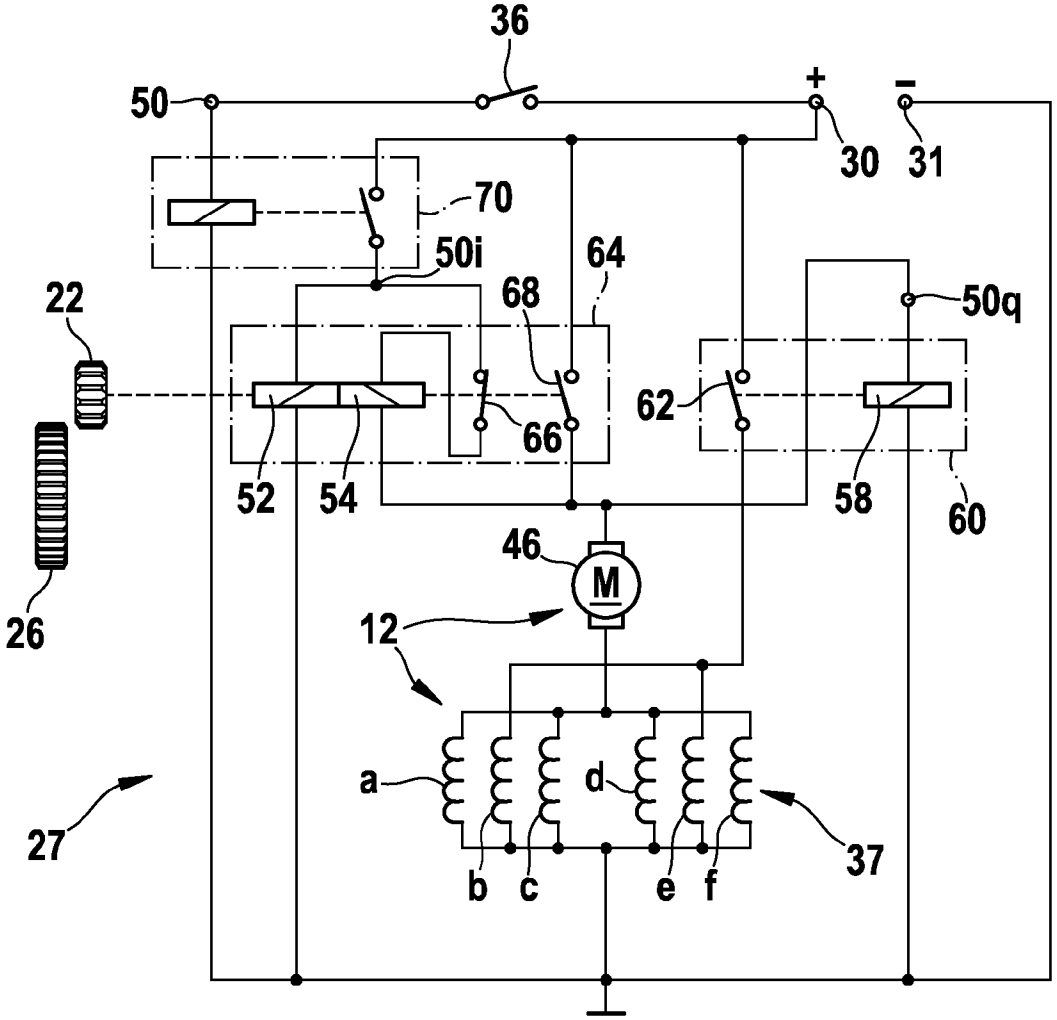

FIG. 6 shows a further circuit variant for passing current through the partial windings a-f of the exciter winding 37. In this embodiment, current is again initially passed through four partial windings a, c, d and f of the excitation winding, analogously to the embodiment pursuant to FIG. 5. The subsequent current feed to the two further partial windings b and e does not take place, however, in series with the armature 46 but in a shunt connection via the switching relay 60, the winding 58 of which is supplied with current in the same manner as in the circuit arrangement pursuant to FIG. 5 via the connection point 50*q* simultaneously with said armature 46 and the series energized partial windings of the exciter winding 37. The closing of the make contact 62, which is likewise delayed by approximately 20-80 ms from the start of excitation, now, however, connects the partial windings b and e in shunt with the armature 46 with ground and therefore facilitates a composite excitation of the starter motor 12. Especially the RPM level of the idle speed of the starter can be adjusted independently of the magnitude of the starter main current.

The inventive embodiment of the starter for an internal combustion engine is especially suited to starting systems, which have the required installation space for one or two additional relays. In this case, the circuit arrangement can be implemented with little additional expense. This is the result of the circuit being implemented with existing components and the service life of the starter being extended. Furthermore, the subdivision of the excitation winding 37 is not limited to a six-pole embodiment of the starter. It is preferably suited to any number of poles of the stator 48, wherein the spatial position of the pole pairs does not deviate too strongly from a diameter alignment. This is also especially true for stator designs having six, eight, ten or twelve poles.

The invention claimed is:

1. A starter for an internal combustion engine comprising a starter motor (12) connected to a direct voltage network (30, 31) by a switching device (27), wherein an excitation winding (37) of the starter motor (12) is divided into several partial windings (a-f), a stator (48) of the starter motor (12) is of six-pole design having six partial windings (a-f) of the excitation winding (37) on three pole pairs, a first group of even-numbered partial windings (a, f) of the excitation winding (37) are connected to the direct voltage network (30, 31) via an engagement relay (49, 64) of the switching device (27), and at least one further group of even-numbered partial windings (b, c, d, e) are switched on in a delayed manner via at least one further switching means (58, 60, 72); wherein the first group of even-numbered partial windings (a, f) is a group of two partial windings, and the further group of even-numbered partial windings (b, c, d, e) includes second and third even-number partial windings (b, e) (c, d) which are groups of two partial windings each.

2. The starter according to claim 1, wherein the partial windings (a-f) are connected in series (FIGS. 3, 4, 5) with an armature (46) of the starter motor (12).

3. The starter according to claim 1, wherein the partial windings (a-f) are disposed on separate poles (47) of the stator (48).

4. The starter according to claim 1, wherein the at least one further switching means (58, 60, 72) of the switching device (27) are configured as relays.

5. The starter according to claim 1, wherein the at least one further group of even-numbered partial windings includes a second group of even-numbered partial windings (b, e) and a third group of even-numbered partial windings (b, e), the first group of even-numbered partial windings (a, f) of the excitation winding (37) are connected in series with the armature (46) of the starter motor (12) to the direct voltage network (30, 31) via a first switching element (49, 64) of the switching device (27), while the second group of even-numbered partial windings (b, e) are switched on in a delayed manner with respect to the first group of partial windings (a, f) and the third group of partial windings (c, d) are switched on in a delayed manner with respect to the second group of partial windings (b, e).

6. The starter according to claim 1, wherein via the switching means (58) of the switching device (27), the at least one further group of even-numbered partial windings (b, e) of the excitation winding (37) are switched on in shunt with the armature (46) of the starter motor (12) in a delayed manner with respect to the other groups of partial windings (a, f; c, d).

7. The starter according to claim 1, wherein the partial windings (a-f) are connected in series and in shunt with an armature (46) of the motor (12).

8. A starter for an internal combustion engine comprising a starter motor (12) connected to a direct voltage network (30, 31) by a switching device (27), wherein an excitation winding (37) of the starter motor (12) is divided into several partial windings (a-f), a stator (48) of the starter motor (12) is of six-pole design having six partial windings (a-f) of the excitation winding (37) on three pole pairs, a first group of even-numbered partial windings (a, f) of the excitation winding (37) are connected to the direct voltage network (30, 31) via an engagement relay (49, 64) of the switching device (27), and a further group of even-numbered partial windings (b, c, d, e) are switched on in a delayed manner via at least one further switching means (58, 60, 72); wherein the first group of even-numbered partial windings (a, f) is a group of two partial windings, and the further group of even-numbered partial windings (b, c, d, e) is a group of four partial windings.

9. The starter according to claim 8, wherein the partial windings (a-f) are disposed on separate poles (47) of the stator (48).

10. The starter according to claim 8, wherein the at least individual switching means (58, 60, 72) of the switching device (27) are configured as relays.

11. The starter according claim 8, wherein a first group of even-numbered partial windings (a, f, c, d) of the excitation winding (37) are connected in series with the armature (46) of the starter motor (12) to the direct voltage network (30, 31) via an engagement relay (49, 64) of the switching device (27) and at least one further group of even-numbered partial windings (b, e), which is likewise connected in series with the armature (46), are switched on in a delayed manner via at least one further switching means (58, 60, 72).

12. The starter according to claim 8, wherein via a switching means (58) of the at least one further switching means of the switching device (27), at least one group of even-numbered partial windings (b, e) of the at least one further group of even-numbered partial windings of the excitation winding (37) are switched on in shunt with the armature (46) of the starter motor (12) in a delayed manner with respect to the other groups of partial windings (a, f; c, d).

13. The starter according to claim 8, wherein the first group of even-numbered partial windings (a, f; c, d) of the excitation winding (37) are connected in series with the armature (46) of the starter motor (12) to the direct voltage network (30, 31) via the engagement relay (49, 64) of the switching device (27), and at least one of the at least one further group of even-numbered partial windings (b, e) are switched on in a delayed manner via at least one further switching means (58, 60, 72).

14. A starter for an internal combustion engine comprising a starter motor (12) connected to a direct voltage network (30, 31) by a switching device (27), wherein an excitation winding (37) of the starter motor (12) is divided into several partial windings (a-f), a stator (48) of the starter motor (12) is of six-pole design having six partial windings (a-f) of the excitation winding (37) on three pole pairs, a first group of even-numbered partial windings (a, c, d, f) of the excitation winding (37) are connected to the direct voltage network (30, 31) via an engagement relay (49, 64) of the switching device (27), and a further group of even-numbered partial windings (b, e) are switched on in a delayed manner via at least one further switching means (58, 60, 72); wherein the first group of even-numbered partial windings (a, c, d, f) is a group of four partial windings, and the further group of even-numbered partial windings (b, e) is a group of two partial windings.

15. The starter according to claim 14, wherein the partial windings (a-f) are disposed on separate poles (47) of the stator (48).

16. The starter according to claim 14, wherein the at least one further individual switching means (58, 60, 72) of the switching device (27) are configured as relays.

17. The starter according claim 1, wherein the first group of even-numbered partial windings (a, f, c, d) of the excitation winding (37) are connected in series with the armature (46) of the starter motor (12) to the direct voltage network (30, 31) via an engagement relay (49, 64) of the switching device (27) and the at least one further group of even-numbered partial windings (b, e), which is likewise connected in series with the armature (46), are switched on in a delayed manner via at least one further switching means (58, 60, 72).

18. The starter according to claim 14, wherein the first group of even-numbered partial windings (a, f) of the excitation winding (37) are connected in series with the armature (46) of the starter motor (12) to the direct voltage network (30,

31) via the engagement relay (49, 64) of the switching device (27), while a second group of the at least one further group of even-numbered partial windings (b, e) are switched on in a delayed manner with respect to the first group of partial windings (a, f) and a third group of the at least one further group of even-numbered partial windings (c, d) are switched on in a delayed manner with respect to the second group of partial windings (b, e).

19. The starter according to claim 14, wherein the first group of even-numbered partial windings (a-f) are connected in series with an armature (46) of the motor (12), and the further group of even-numbered partial windings are connected in shunt with the armature (46).

* * * * *